US007220949B2

(12) United States Patent
Lee et al.

(10) Patent No.: US 7,220,949 B2
(45) Date of Patent: May 22, 2007

(54) CAPACITOR OF MAGNETRON

(75) Inventors: Jong Soo Lee, Anyang-si (KR); Yong Soo Lee, Siheung-si (KR); Seung Won Baek, Seoul (KR)

(73) Assignee: LG Electronics, Inc., Seoul (KR)

( * ) Notice: Subject to any disclaimer, the term of this patent is extended or adjusted under 35 U.S.C. 154(b) by 10 days.

(21) Appl. No.: 11/205,137

(22) Filed: Aug. 17, 2005

(65) Prior Publication Data

US 2006/0219714 A1 Oct. 5, 2006

(30) Foreign Application Priority Data

Apr. 4, 2005 (KR) ..... 10-2005-0028209

(51) Int. Cl.
*H05B 6/72* (2006.01)

(52) U.S. Cl. ..... 219/761; 361/15; 361/302

(58) Field of Classification Search ..... 219/761, 219/716, 690, 697, 695, 757, 702, 738; 361/302, 361/520, 305, 345, 330, 540, 15; 315/39.51
See application file for complete search history.

(56) References Cited

U.S. PATENT DOCUMENTS 4,814,938 A * 3/1989 Arakawa et al. ..... 361/302
4,900,985 A * 2/1990 Tashiro et al. ..... 315/39.51

* cited by examiner

*Primary Examiner*—Quang Van
(74) *Attorney, Agent, or Firm*—Birch, Stewart, Kolasch & Birch, LLP

(57) ABSTRACT

Disclosed herein is a capacitor for a magnetron. The capacitor has dielectric members, which have a converging angle of less than 180° defined between lines extending from both sides of each dielectric member formed between corresponding ends of inner and outer electrodes of the dielectric member. The capacitor is reduced in size while having enhanced capacitance, thereby reducing a manufacturing time. The capacitor also has central conductors having enlarged portions larger than the inner electrode, thereby further enhancing the capacitance.

14 Claims, 8 Drawing Sheets

CAPACITOR OF MAGNETRON

This application claims the benefit of the Korean Patent Application No. 2005-028209, filed on Apr. 4, 2005, which is hereby incorporated by reference as if fully set forth herein.

BACKGROUND OF THE INVENTION

1. Field of the Invention

The present invention relates to a magnetron, and more particularly, to a capacitor of a magnetron, designed to have excellent withstand voltage and capacitance, thereby enhancing noise shielding efficiency, and allowing reduction in filling amount of insulating filler in the capacitor together with size reduction of the capacitor.

2. Discussion of the Related Art

Generally, a magnetron is applied to microwave ovens, plasma illuminating devices, driers, and other high frequency systems. In the magnetron, thermal electrons are emitted to a cathode by application of power, and generate microwaves by electromagnetic field. Then, the microwaves are output as a heat source to heat a target.

A conventional magnetron will be described with reference to FIGS. 1 to 4.

Referring to FIG. 1, the overall construction of the magnetron will be described.

The magnetron generally comprises a high frequency generator for generating microwaves by an applied voltage, an output portion for emitting the microwaves generated from the high frequency generator, and an input portion for applying a the voltage to the high frequency generator.

The high frequency generator of the magnetron comprises upper and lower plate-shaped yokes 11*a* and 11*b*, an anode cylinder 12, cooling fins 13, upper and lower magnetic poles 14*a* and 14*b*, an A-shaped seal member 15*a*, an F-shaped seal member 15*b*, a ceramic stem 16, magnets 17*a* and 17*b*, vanes 21, and a cathode 22.

The anode cylinder 12 is located in an inner space defined between the upper and lower yokes 11*a* and 11*b*.

Each of the cooling fins 13 is connected at one end to the anode cylinder 12 and at the other end to the upper or lower yoke plate 11*a* or 11*b*. The cooling fins 13 act to dissipate heat from the anode cylinder 12 to the upper and lower yokes 11*a* and 11*b*.

The upper and lower magnetic poles 14*a* and 14*b* are disposed to upper and lower ends of the anode cylinder 12, respectively. The A-shaped seal member 15*a* is equipped to surround an outer surface of the upper magnetic pole 14*a*, and the F-shaped seal member 15*b* is equipped to surround an outer surface of the lower magnetic pole 14*a*. The magnets 17*a* and 17*b* are equipped to the outer surfaces of the upper and lower magnetic poles.

The upper and lower magnetic poles 14*a* and 14*b*, the A-shaped seal member 15*a* and the F-shaped seal member 15*b*, and the magnets 17*a* and 17*b* are symmetrically equipped to the upper and lower ends of the anode cylinder 12, respectively.

The lower end of the F-shaped seal member 15*b* is opened, and the ceramic stem 16 is equipped thereto. The ceramic stem 16 is penetrated with an outer connecting lead 25, which is connected to a center lead 23 and a side lead 24.

The anode cylinder 12, the A-shaped seal member 15*a*, the F-shaped seal member 15*b*, and the ceramic stem 16 close a space from which the microwaves are generated.

The anode cylinder 12 has the vane 21 equipped therein, and is formed at the center of the vane 21 with a chamber

21*a* where the microwaves are generated. The chamber 21*a* of the vane is equipped with the cathode 22 to which the center lead 23 is inserted. At this time, the vane 21 acts as a positive electrode, and the cathode 22 acts as a negative electrode. The microwaves are generated by interaction of the vane and the cathode.

The output portion of the magnetron comprises an antenna feeder 31, an A-shaped ceramic member 32, and an antenna cap 33.

The antenna feeder 31 is connected to the vane 21, and the A-shaped ceramic member 32 is located between an upper end of the A-shaped seal member 15*a* and the antenna cap 33. Thus, the microwaves generated from the chamber 21*a* of the vane 21 and the cathode 22 are guided by the antenna feeder 31, and are then emitted to the outside through the A-shaped ceramic member 32.

The input portion of the magnetron comprises a filter box 40, a capacitor 50, and a choke coil 60.

The filter box 40 is fixed to a lower end of the high frequency generator. The capacitor 50 is fixed to the filter box 40 while being connected to the choke coil 60, which is connected to the outer connecting lead 25 while being located inside the filter box 40.

The filter box 40 is spaced a predetermined distance for insulation from the choke coil 60, a coupled portion between the outer connecting lead 25 and the choke coil 60, and the outer connecting lead 25. Moreover, the filter box 40 is made of an electrically conductive material, such as a steel plate, so as to prevent the microwaves from being leaked to the outside.

The capacitor 50 will be described with reference to FIG. 2.

The capacitor 50 comprises an insulating case 51 fixedly inserted into the filter box 40, an insulating base 52 equipped to one end of the insulating case 51, two central conductors 53 inserted into the insulating base 52, a dielectric material 54 surrounding the central conductors 53 within the insulating case 51, insulating filler 55 filled in the insulating case 51, and a ground plate 56 equipped to the one end of the insulating case 51 while being grounded to the filter box 40.

After the central conductors 53 and the dielectric material 54 are fixed in the insulting case 51, the insulating case is filled with the insulating filler 55, and the insulating filler 55 is cured for a predetermined period of time (about 10 hours). The insulating filler 55 includes an epoxy resin.

The dielectric members constituting the capacitor will be described with reference to FIGS. 3 and 4.

The dielectric members 54 are disposed between the outer surfaces of the central conductors 52 and the insulating case 51 so as to face each other. The dielectric members 54 consist of barium titanate, $BaTiO_3$.

Each of the dielectric members 54 is substantially formed in a semicircular shape, and is formed with inner and outer electrodes 54*a* and 54*b* on inner and outer surfaces thereof, respectively. Here, the inner and outer electrodes 54*a* and 54*b* are formed in semicircular shapes.

The inner and outer electrodes 54*a* and 54*b* are formed by plating a material having excellent electric conductivity, such as silver, on the surfaces of the electrodes. Here, the inner electrode 54*a* contacts the rod-shaped central conductor 52, and the outer electrode 54*b* is connected to the ground plate 56. The dielectric members 54 have predetermined withstand voltage and capacitance.

In order to produce a capacitor having a higher capacitance with a reduced size, it is advantageous to increase the withstand voltage and capacitance of the dielectric members 54. Here, the withstand voltage and capacitance of the dielectric members 54 are proportional to the dielectric constant $\epsilon$ of the dielectric members, effective surface areas of the inner and outer electrodes 54*a* and 54*b*, and wire diameters of the central conductors 53, but inversely proportional to the distance between the inner electrode and the outer electrode. Here, the dielectric constant $\epsilon$ is determined by a dielectric material, the effective surface areas are defined by heights and widths of the respective electrodes, and the wire diameter of the central conductors is defined by the radius a of the inner electrode.

The capacitances of the dielectric members 54 are varied according to the shapes thereof. Moreover, when the dielectric members have a higher withstand voltage, a capacitor can be manufactured to have a large capacitance with a reduced size by reducing the distance between the inner electrode 54*a* and the outer electrode 54*b*.

Meanwhile, the ground plate 56 extends to the outside of the insulating case 51, and is grounded to the filter box 40. As a result, the inner and outer electrodes 54*a* and 54*b*, and the dielectric members 54 are grounded while repeating charge and discharge of electrons through the ground plate 56.

Operation of the magnetron constructed as described above will now be described as follows.

When power is applied to the magnetron, a predetermined voltage is supplied to the central conductors 53 of the capacitor 50. At this time, the dielectric members 54 have predetermined withstand voltage and capacitance.

The dielectric members 54 perform charge and discharge of electrons through the ground plate 56, and stabilize overvoltage surges applied to the capacitor. The capacitor supplies the stabilized voltage to the leads 23 and 24 through the outer connecting lead 25. Additionally, direct current is generated by interaction between the capacitor 50 and the choke coil 60, thereby shielding noise.

Electrons are emitted from the cathode 22 to the vane 21, so that microwaves are generated from the chamber of the vane. Then, the microwaves are guided to the outer portion by the antenna feeder 31 connected to the vane 21, and radiated through the A-shaped ceramic member.

However, the capacitor for the conventional magnetron has problems as follows.

Firstly, although the dielectric members are formed to have the semicircular shapes in order to increase the effective surface areas of the dielectric members, the outer electrode is formed to have an undesirably enlarged surface area compared to that of the inner electrode. That is, the outer electrode has the undesirably enlarged surface area compared to an effective surface area thereof. Thus, the size, in particular, a width W, of the capacitor is increased, and the amount of epoxy resin required to fill the insulating case is undesirably increased, thereby increasing the time for curing the epoxy resin. As a result, there are problems of increasing a time for manufacturing the products, a price of the products, and the size of the capacitor.

Secondly, the wire diameter of the central conductors is also increased in order to increase the withstand voltage and capacitance of the capacitor. However, in order to increase the wire diameter of the central conductors, the diameter of the central conductors must be greatly increased. In this case, costs for manufacturing the central conductors are increased, so that the sizes of the central conductors and the capacitor are increased together with an increase of a filling amount of the epoxy resin.

Thirdly, since the dielectric members have the semicircular shapes, the outer diameter of the dielectric members is remarkably increased when increasing a distance b-c between the inner electrode and the outer electrode. As a result, as the size of the dielectric members is remarkably increased, the size of the capacitor and the filling amount of the epoxy resin are increased.

SUMMARY OF THE INVENTION

Accordingly, the present invention is directed to a magnetron that substantially obviates one or more problems due to limitations and disadvantages of the related art.

An object of the present invention is to provide a capacitor of a magnetron, designed to have excellent withstand voltage and capacitance, and to have a reduced size and a filling amount of epoxy resin, thereby reducing the time for manufacturing products employing the magnetron.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a capacitor of a magnetron comprises: two central conductors disposed inside a ground plate and connected to a choke coil; and two dielectric members disposed at the outside of the central conductors so as to face each other, respectively, each dielectric member including inner and outer electrodes disposed on inner and outer surfaces thereof such that the inner electrode is connected to an associated central conductor and the outer electrode is connected to the ground plate, wherein a converging angle of less than 180° is defined between lines extending from both sides of the dielectric member, each side being formed between corresponding ends of the inner and outer electrodes.

Preferably, the converging angle is 65~80°.

The inner electrode of the dielectric member may have either a round shape or a flat shape. Moreover, the outer electrode of the dielectric member may have either a round shape or a flat shape.

Preferably, each of the central conductors corresponds to the inner electrode of the dielectric member, and has an enlarged portion larger than the inner electrode. For example, the enlarged portion may have either a round shape or a flat shape.

In another aspect of the present invention, a capacitor of a magnetron comprises: two central conductors disposed inside a ground plate and connected to a choke coil, each of the central conductors having an enlarged portion formed to have a larger diameter than that of the central conductor at a predetermined portion thereof; and two dielectric members disposed at the outside of the central conductors so as to face each other, respectively, each dielectric member including inner and outer electrodes disposed on inner and outer surfaces thereof such that the inner electrode is connected to the enlarged portion of an associated central conductor and the outer electrode is connected to the ground plate.

The enlarged portion may have either a round shape or a flat shape.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The preferred embodiments of the invention will now be described with reference to FIGS. 1 to 5.

Figure 5:
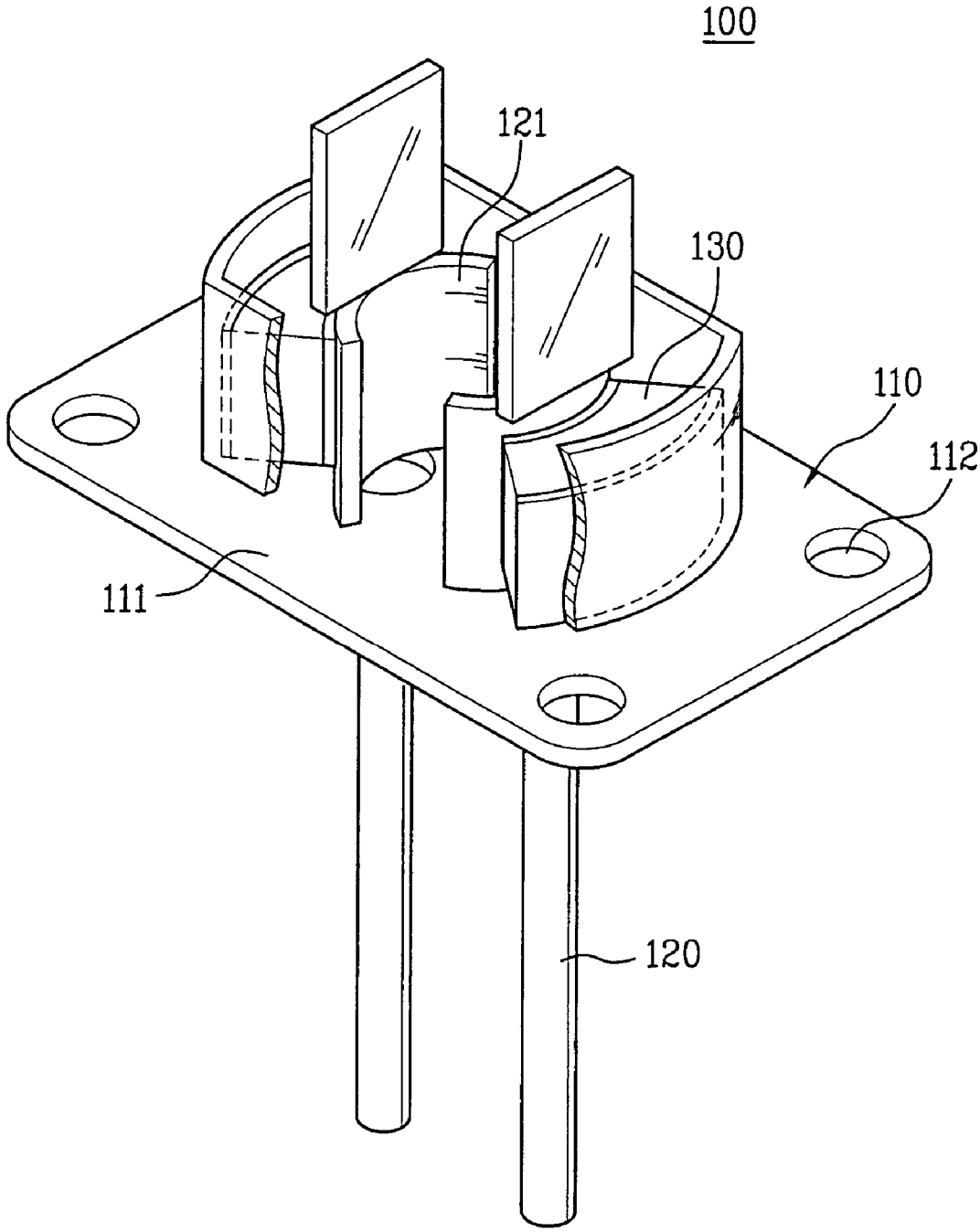
FIG. 5 is a perspective view illustrating one embodiment of a capacitor according to the present invention.
Figure 6:
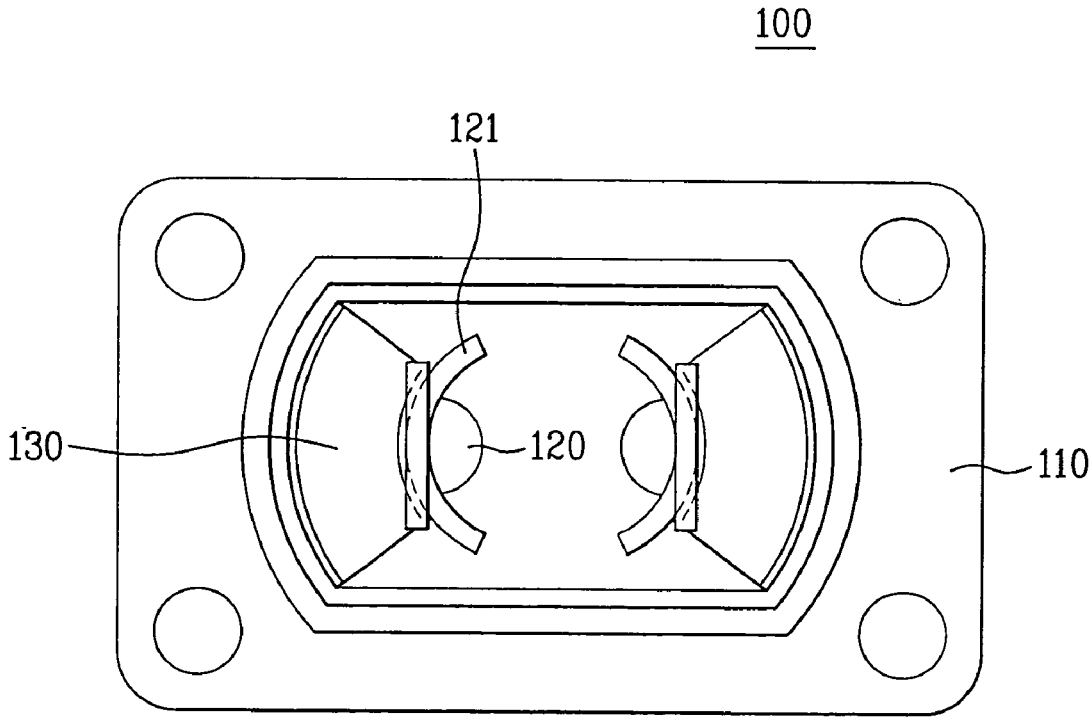
FIG. 6 is a top view illustrating the capacitor of FIG. 5.

Referring to FIGS. 5 and 6, a capacitor 100 of a magnetron of the invention will be described. In FIG. 5, an insulating case and insulating filler are not illustrated since they have the same constructions as those of the conventional magnetron.

The capacitor 100 comprises two central conductors 120 disposed inside a ground plate 110 and connected to a choke coil, and two dielectric members 130 disposed at the outside of the central conductors 120 so as to face each other, respectively. Each dielectric member 130 includes inner and outer electrodes 131 and 132 disposed on inner and outer surfaces thereof such that the inner electrode 131 is connected to an associated central conductor 120 and the outer electrode 132 is connected to the ground plate 110. A converging angle θ of less than 180° is defined between lines extending from both sides of the dielectric member 130, in which each side of the dielectric material 130 is formed between corresponding ends of the inner and outer electrodes 131 and 132.

Figure 1:
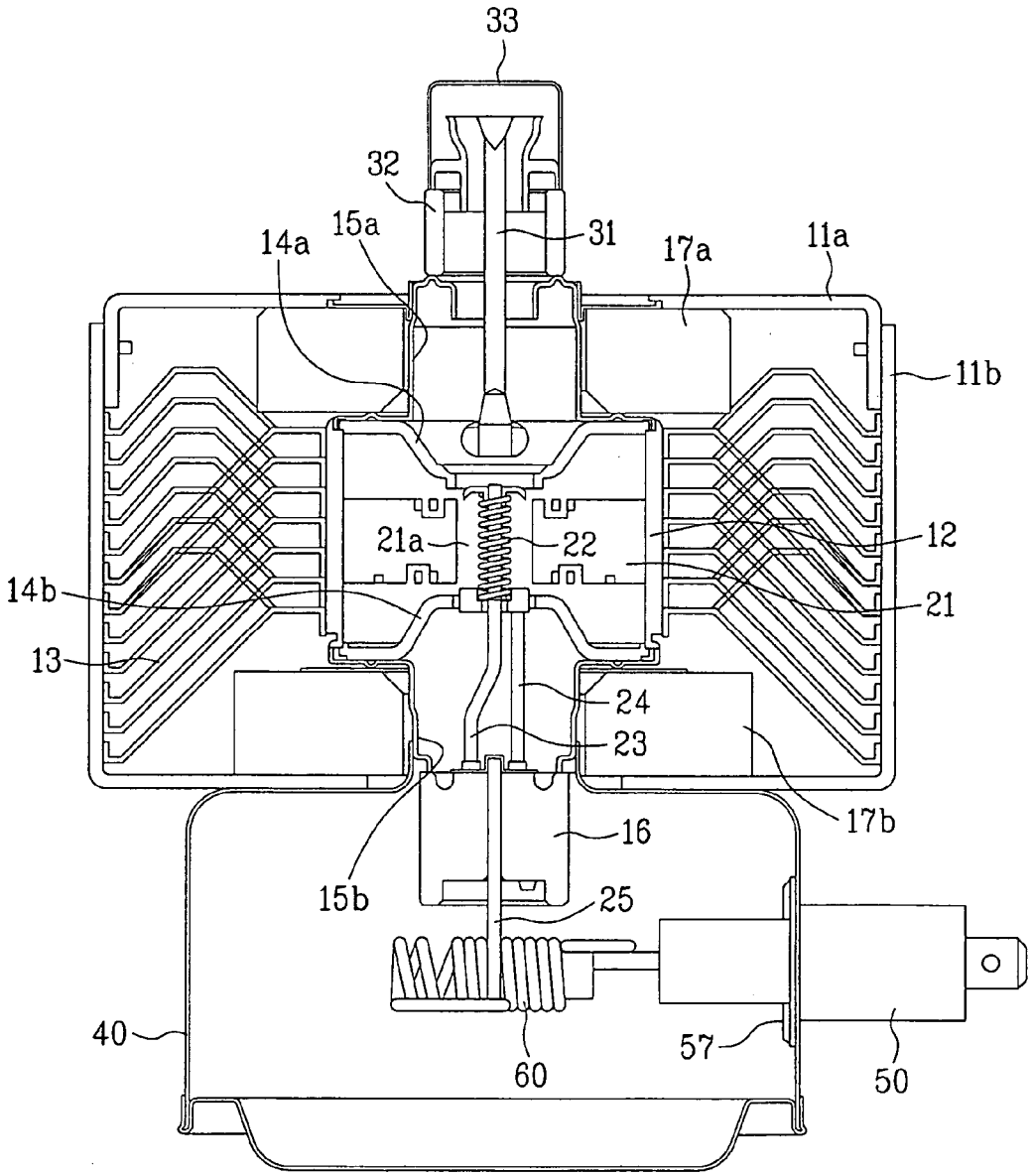
FIG. 1 Prior Art
FIG. 1 is a constructional view illustrating a conventional magnetron.
Figure 2:
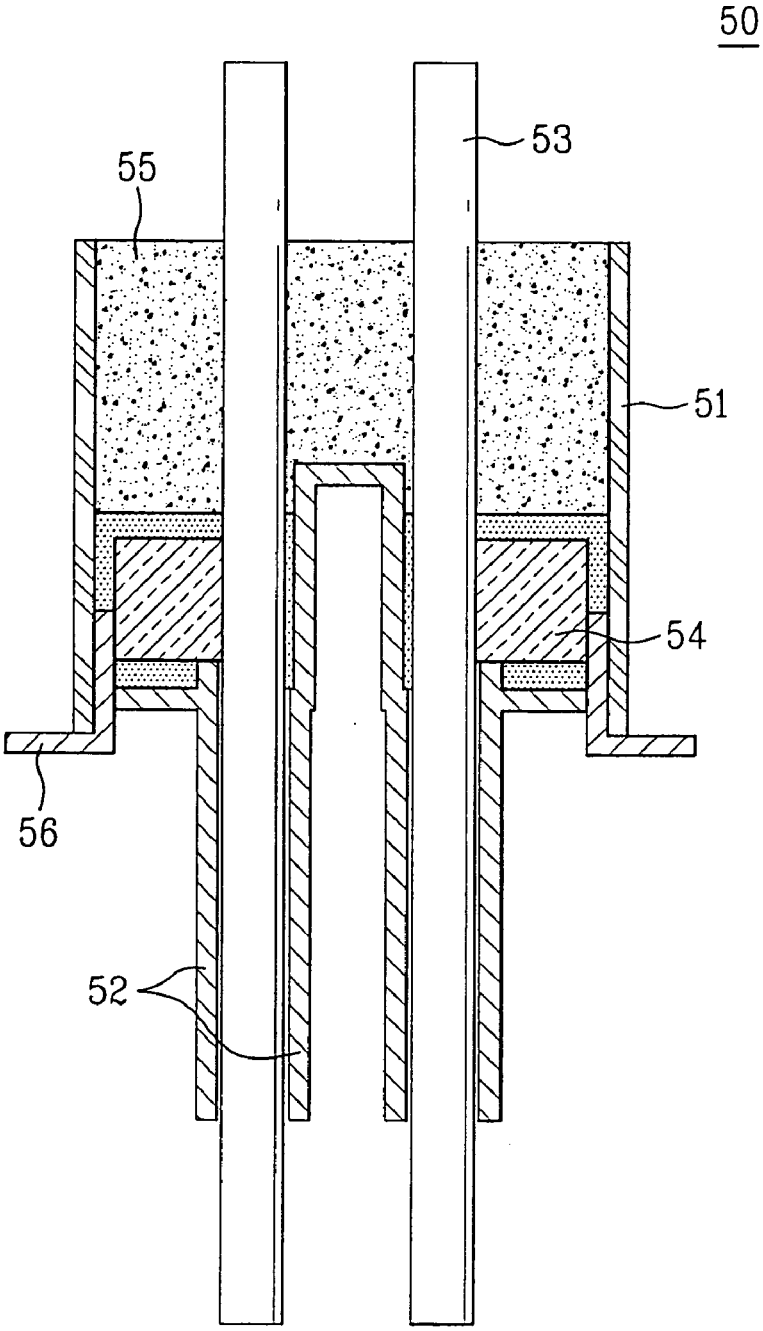
FIG. 2 Prior Art
FIG. 2 is a cross-sectional view illustrating a capacitor of FIG. 1.
Figure 3:
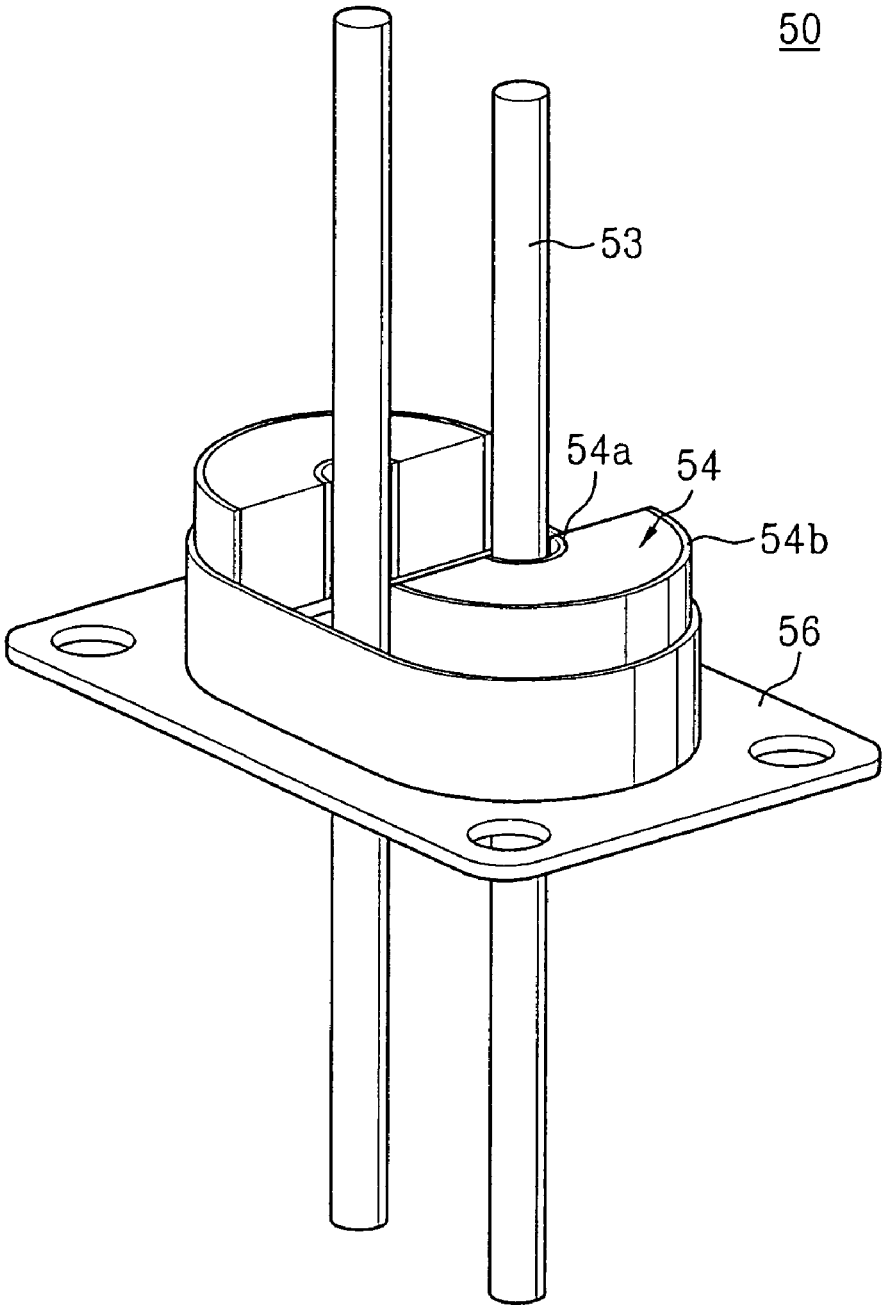
FIG. 3 Prior Art
FIG. 3 is a perspective view illustrating the capacitor of FIG. 1.

The ground plate 110 is equipped to one end of the insulting case 51 (see FIG. 2) while being grounded to the filter box 40 (see FIG. 1). The ground plate 110 has a substantially rectangular shape opened at both sides thereof, and has a flange 111 extending perpendicular to the ground plate 110 toward the outside. The flange 111 is formed with fastening holes 112 for fastening the ground plate 112 to the filter box.

The insulating case is filled with the insulating filler, which fills a space between the dielectric members 130 and an upper space of the case. The insulating filler is the same as that of the conventional magnetron.

Each of the dielectric members 130 is formed with the inner and outer electrodes 131 and 132 on inner and outer surfaces thereof, respectively. The inner and outer electrodes 131 and 132 are formed by plating a material having excellent electric conductivity, such as silver, on their surface.

A first embodiment of the dielectric members will be described with reference to FIG. 7.

The inner and outer electrodes 131 and 132 of each dielectric member 130 preferably have a round shape. Alternatively, the inner and outer electrodes 131 and 132 may have a circular or elliptical shape. As such, when the inner and outer electrodes 131 and 132 of the dielectric member 130 are formed to have the round shapes, the inner and outer electrodes have larger effective surface areas than when they have flat shapes. In particular, when the inner and outer electrodes 131 and 132 are formed to have the elliptical shapes, the effective surface areas of the electrodes can be further increased in comparison to the circular shape.

More preferably, the converging angle θ defined between the lines extending from both sides of the dielectric member 130 is about 65~80°, in which each side of the dielectric material 130 is formed between the corresponding ends of the inner and outer electrodes 131 and 132. This converging angle can remarkably reduce the width of the dielectric members 130 in comparison to the conventional construction while securing the effective surface areas of the inner and outer electrodes 131 and 132, thereby permitting desired capacitance and withstand voltage.

Moreover, although the distance between the inner and outer electrodes 131 and 132 of the dielectric members 130 is increased, the size of the dielectric members 130 is only slightly increased, and thus the size, in particular, the width, of the capacitor 100 is not significantly increased. As a result, the amount of the insulating filler is not significantly increased.

Figure 8:
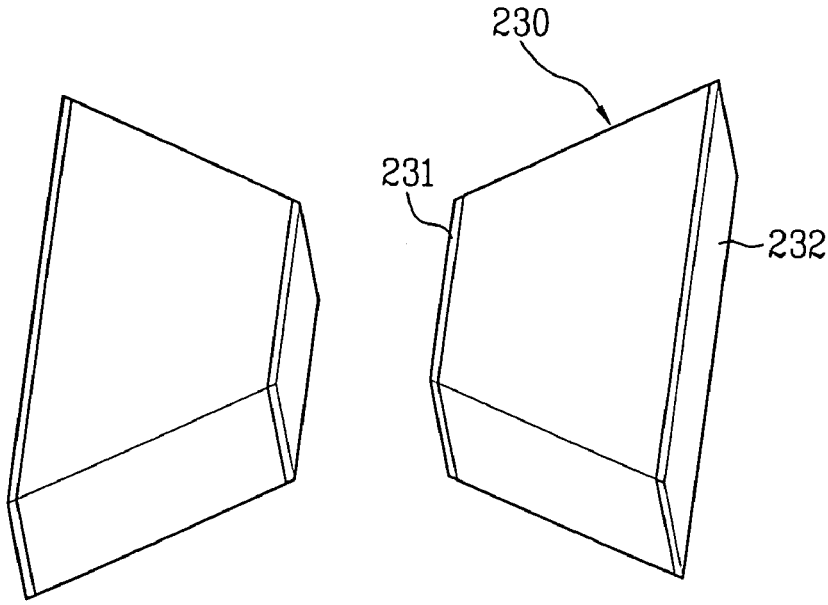
FIG. 8 is a perspective view illustrating an alternative example of the dielectric members of FIG. 5.

A second embodiment of the dielectric members will be described with reference to FIG. 8.

Inner and outer electrodes 231 and 232 of each dielectric member 230 preferably have a flat shape. As a result, the inner and outer electrodes 231 and 232 cannot but have reduced effective surface areas in comparison to the electrodes having the round shape as shown in FIG. 7. On the contrary, the dielectric members 230 are advantageous in terms of enhanced quality thereof and reduced frequency of defective products since they allow stable formation and treatment of the electrodes.

Although not shown in the drawings, alternatives of the dielectric member will be described.

The inner and outer electrodes of each dielectric member may have a round shape and a flat shape, respectively. In this manner, the inner electrode can have a greater effective surface area than that of the outer electrode.

The inner and outer electrodes of each dielectric member may have a flat shape and a round shape, respectively. In this manner, the outer electrode can have a greater effective surface area than that of the inner electrode, and the width of the dielectric members can be reduced.

Figure 9:
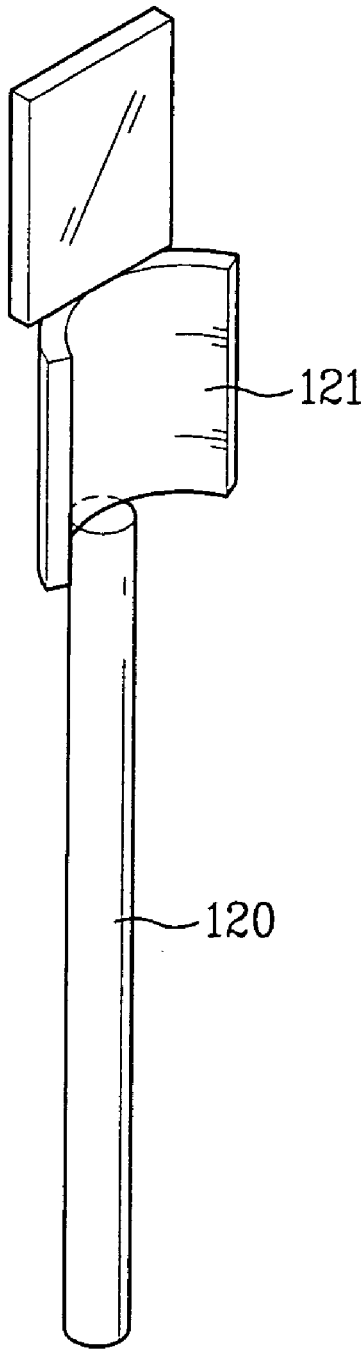
FIG. 9 is a perspective view illustrating a central conductor of FIG. 5.

The construction of the central conductors will be described with reference to FIG. 9.

Each of the central conductors 120 contacts the inner electrode 131 of the dielectric member 130, and has the enlarged portion 121 having a larger diameter than that of the central conductor. With the enlarged portion 121, the wire diameter of the central conductor 120 is increased without increasing the diameter of the central conductor 120, thereby allowing the capacitance of the capacitor 100 to be increased. Preferably, the enlarged portion 121 has a slightly larger area than that of the inner electrode 131.

It is desirable that the enlarged portion 121 be equipped to come to tight contact with the inner electrode 131 of the dielectric member 130. For example, when the inner electrode 131 has the round shape as shown in FIG. 7, it is desirable that the enlarged portion 121 also have a round shape as shown in FIG. 9. On the other hand, when the inner electrode 231 has the flat shape as shown in FIG. 8, it is desirable that the enlarged portion 121 also has a flat shape.

Operation of the capacitor constructed as described above according to the invention will be described.

In order to generate microwaves having a predetermined frequency from the magnetron, a predetermined voltage must be supplied to the magnetron. Generally, a voltage of 20 kV is supplied to the magnetron.

At this time, the maximum electric field E applied to the dielectric members 130 can be determined as $E=V/\ln(b/a)$, and a capacitance C of the capacitor 100 can be determined as $C=2\pi \in L/\ln(b/a)$, in which a indicates the distance from the center of the dielectric member to the inner electrode 131, b indicates the distance from the center of the dielectric member to the outer electrode 132, and L indicates the height of the dielectric member.

At this time, since the maximum electric field E overcomes the insulative capacity, a lower maximum electric field E and a higher capacitance C are advantageous to manufacture the capacitor 100 with the reduced size and large capacitance.

Tests were performed by supplying a voltage of 20 kV to the magnetron, and results of the maximum electric field E, the withstand voltage, and the capacitance were obtained as follows. Here, the dielectric members 130 of the invention had a converging angle of 72° defined between the lines extending from both sides of each dielectric member 130, in which each side is formed between corresponding ends of the inner and outer electrodes 131 and 132.

Figure 4:
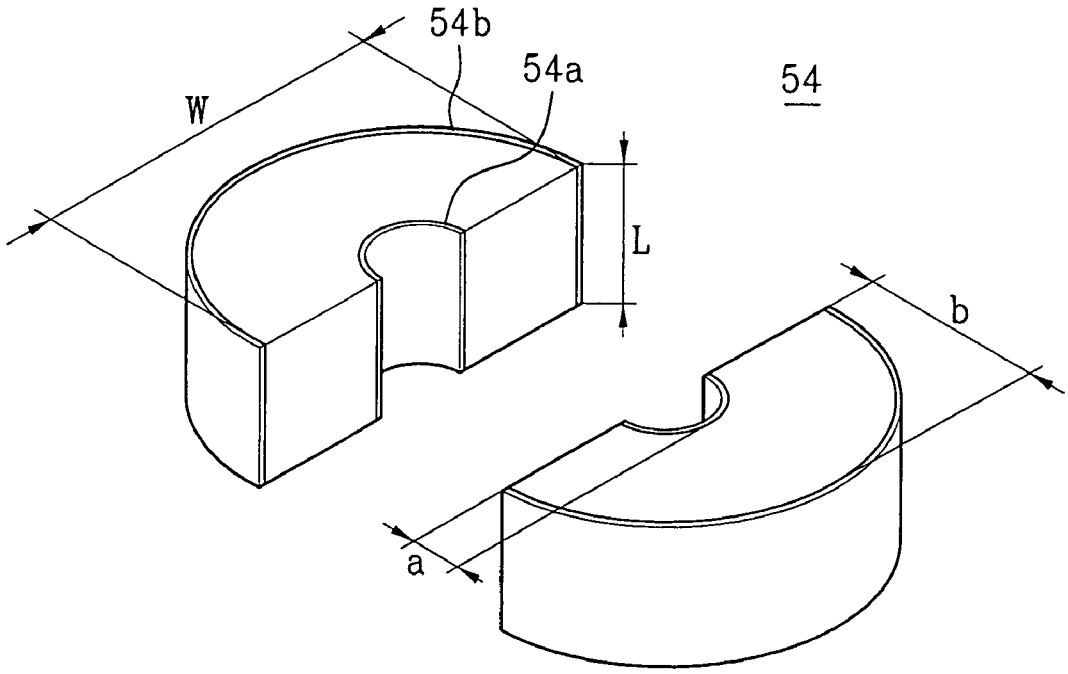
FIG. 4 Prior Art
FIG. 4 is a perspective view illustrating dielectric members of the capacitor of FIG. 1.

Referring to FIG. 4, each conventional dielectric member 54 has a maximum electric field E of 9.0 kV/mm when a=1.45 mm, b=6.5 mm, L=5.0 mm, and V=20 kV.

Figure 7:
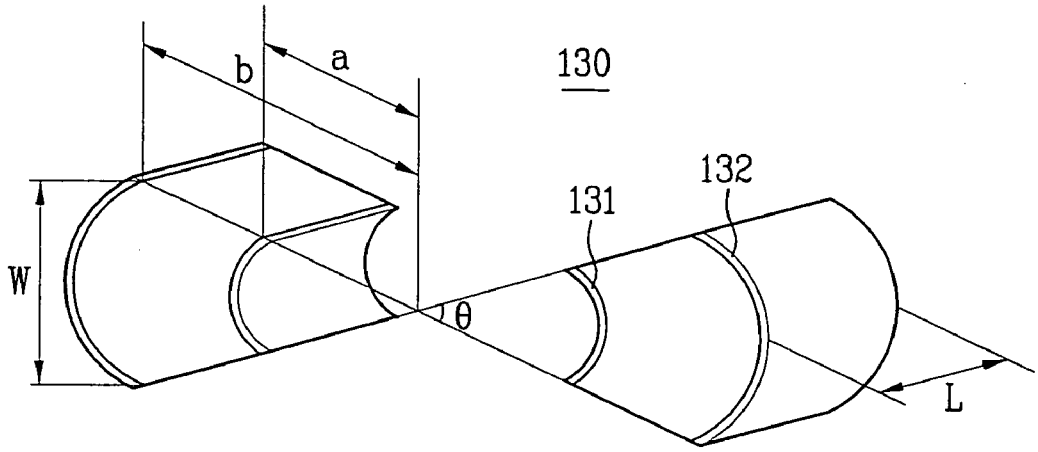
FIG. 7 is a perspective view illustrating one example of dielectric members of FIG. 5.

Referring to FIG. 7, each dielectric member 130 of the invention has a maximum electric field E of 6.5 kV/mm when a=4.7 mm, b=9.0 mm, L=5.5 mm, and V=20 kV.

As such, according to the invention, it can be appreciated that, since the maximum electric field E serving as the insulation destructing pressure is lowered, the withstand voltage of the invention is enhanced by 2.5 kV/mm from 9.0 kV/mm to 6.5 kV/mm, resulting in an increase of the capacitance.

Additionally, the conventional dielectric member 54 has a distance (a-b) of 5.50 mm between the inner and outer electrodes 54*a* and 54*b*, whereas the dielectric member 130 of the invention has a distance (a-b) of 4.3 mm between the inner and outer electrodes 131 and 132. As a result, according to the invention, the inner and outer electrodes 131 and 132 are reduced in size, whereby the size of the capacitor 100 can be reduced. Moreover, since the dielectric members 130 of the invention are significantly reduced in width, the size of the capacitor 100 can be further reduced.

A high voltage capacitor 100 for a typical magnetron requires a capacitance of about 300~500 pF. To achieve this capacitance, the dielectric members 54 have a volume of 630 $mm^3$, whereas the dielectric members 130 of the invention have a volume of 500 $mm^3$, which is reduced about 21% of that the conventional dielectric member 54.

As apparent from the above description, the present invention has effects as follows.

Firstly, according to the invention, as the width of the dielectric member is remarkably reduced by reducing a substantial surface area of an outer electrode, the size and width of a capacitor can be reduced while maintaining the same capacitance. Moreover, even if the distance between the inner and outer electrodes is increased, the size of the dielectric member is not significantly increased.

Secondly, a withstand voltage and a capacitance are enhanced, thereby allowing a capacitor having a reduced size and a large capacitance to be manufactured.

Thirdly, as the size of the capacitor is reduced, the amount of insulating filler is reduced. Moreover, the curing time of the insulating filler is shortened, thereby reducing the manufacturing time.

Fourthly, since each central conductor has an enlarged portion formed at a predetermined portion thereof and an enlarged wire diameter, the wire diameter of the central conductor contacting the inner electrode can be increased without increasing the diameter of the central conductor. Thus, the capacitance can be further enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A capacitor of a magnetron, comprising:

two central conductors disposed inside a ground plate and connected to a choke coil; and two dielectric members disposed at the outside of the central conductors so as to face each other, respectively, each dielectric member including inner and outer electrodes disposed on inner and outer surfaces thereof such that the inner electrode is connected to an associated central conductor and the outer electrode is connected to the ground plate, wherein a converging angle of less than 180° is defined between lines extending from both sides of the dielectric member, each side being formed between corresponding ends of the inner and outer electrodes.

2. The capacitor as set forth in claim 1, wherein the converging angle is 65~80°.

3. The capacitor as set forth in claim 1, wherein the inner electrode has a round shape.

4. The capacitor as set forth in claim 3, wherein the outer electrode has a round shape.

5. The capacitor as set forth in claim 3, wherein the outer electrode has a flat shape.

6. The capacitor as set forth in claim 3, wherein each central conductor has a round shape to come into face-to-face contact with the inner electrode, and has an enlarged portion larger than the inner electrode.

7. The capacitor as set forth in claim 1, wherein the outer electrode has a round shape.

8. The capacitor as set forth in claim 7, wherein the inner electrode has a flat shape.

9. The capacitor as set forth in claim 7, wherein each central conductor has a flat shape to come into face-to-face contact with the inner electrode, and has an enlarged portion larger than the inner electrode.

10. The capacitor as set forth in claim 1, wherein the inner electrode has a flat shape.

11. The capacitor as set forth in claim 10, wherein the outer electrode has a flat shape.

12. The capacitor as set forth in claim 11, wherein each central conductor has a flat shape to come into face-to-face contact with the inner electrode, and has an enlarged portion larger than the inner electrode.

13. The capacitor as set forth in claim 1, wherein the outer electrode has a flat shape.

14. The capacitor as set forth in claim 1, wherein the ground plate is located at one end of an insulating case, and insulating filler is located at the other end of the insulating case.

* * * * *